US009638143B2

(12) United States Patent
Ito

(10) Patent No.: US 9,638,143 B2
(45) Date of Patent: May 2, 2017

(54) VAPORIZED FUEL PROCESSING APPARATUS

(71) Applicant: AISAN KOGYO KABUSHIKI KAISHA, Obu-shi, Aichi-ken (JP)

(72) Inventor: Yuzuru Ito, Chiryu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

(21) Appl. No.: 14/714,523

(22) Filed: May 18, 2015

(65) Prior Publication Data

US 2015/0330338 A1 Nov. 19, 2015

(30) Foreign Application Priority Data

May 19, 2014 (JP) ..... 2014-102996

(51) Int. Cl.
*F02M 25/08* (2006.01)
*F02D 41/24* (2006.01)
*F02D 41/00* (2006.01)

(52) U.S. Cl.
CPC ..... *F02M 25/0836* (2013.01); *F02D 41/004* (2013.01); *F02D 41/2441* (2013.01); *F02D 41/2464* (2013.01); *F02M 25/089* (2013.01)

(58) Field of Classification Search
CPC ..... F02M 25/0836; F02M 25/089; F02M 25/0854; F02M 25/0809; F02M 25/0818; F02M 25/08; F02M 2025/0881; F02M 2025/0872; F02D 41/004; F02D 41/0032
USPC ..... 123/518, 519, 520, 521
See application file for complete search history.

(56) References Cited

U.S. PATENT DOCUMENTS 6,276,343 B1 * 8/2001 Kawamura ..... F02M 25/0809 123/516
6,418,915 B1 * 7/2002 Harrigan, Sr. ..... F02D 33/006 123/198 D
6,470,862 B2 10/2002 Isobe et al.
2009/0099795 A1 * 4/2009 Behar ..... F02M 25/0818 702/51
2011/0067487 A1 * 3/2011 Haag ..... B60K 15/03504 73/40
2015/0159567 A1 * 6/2015 Akita ..... F02D 41/003 137/624.27

FOREIGN PATENT DOCUMENTS

JP 2001214817 A 8/2001

* cited by examiner

*Primary Examiner* — Sizo Vilakazi
(74) *Attorney, Agent, or Firm* — Conley Rose, P.C.

(57) ABSTRACT

A vaporized fuel processing apparatus has a fuel tank, a canister configured to adsorb vaporized fuel and connected to an internal combustion engine, a vapor path connecting the fuel tank to the canister, a closing valve having a stepping motor and configured to open and close the vapor path, and an electric control unit configured to cause the closing valve to an initial position in order to initialize the closing valve. The electric control unit is configured to determine whether it is in a predetermined initialization permission time when the initialization of the closing valve does not adversely affect running of the internal combustion engine. When it is determined that it is in the predetermined initialization permission time, the electric control unit is configured to output signals to start the initialization of the closing valve.

6 Claims, 6 Drawing Sheets

VAPORIZED FUEL PROCESSING APPARATUS

CROSS-REFERENCE TO RELATED APPLICATIONS

This application claims priority to Japanese patent application serial number 2014-102996, filed May 19, 2014, the contents of which are incorporated herein by reference.

STATEMENT REGARDING FEDERALLY SPONSORED RESEARCH OR DEVELOPMENT

Not applicable.

BACKGROUND

This disclosure relates to a vaporized fuel processing apparatus having a stepping motor type closing valve for opening and closing a path connecting a fuel tank with a canister.

Japanese Laid-Open Patent Publication No. 2001-214817 discloses a conventional vaporized fuel processing apparatus having a path connecting a fuel tank with the internal combustion engine and configured to supply vaporized fuel from the fuel tank into the internal combustion engine. When the vaporized fuel leaks from the path, the vaporized fuel processing apparatus closes an atmospheric port of the canister in order to apply negative pressure to a place where the vaporized fuel leaks. As a result, the leak of the vaporized fuel into the atmosphere can be prevented. While, another vaporized fuel processing apparatus uses a stepping motor type closing valve, which can control the open amount of the closing valve linearly.

In a case of the stepping motor type closing valve, there is a possibility that a stepping motor break down may be caused by step-out (i.e., where the actual position of the stepping motor and associated valve does not correspond with the assumed position of the motor and valve by the controller or controller unit). In a case that a device having a stepping motor is used, when the stepping motor steps out, the stepping motor is usually initialized and is restarted. In a case of the vaporized fuel processing apparatus, when the stepping motor steps out during working of the vaporized fuel processing apparatus, the stepping motor is caused to be in an initial position such that the stepping motor type closing valve is open or closed. Thus, there is a possibility that the amount of the vaporized fuel flowing into the internal combustion engine suddenly changes, and that the air-fuel ratio in the internal combustion engine becomes disturbed. Accordingly, there has been a need for improved vaporized fuel processing apparatuses.

BRIEF SUMMARY

In one aspect of this disclosure, a vaporized fuel processing apparatus has a fuel tank, a canister configured to adsorb vaporized fuel and connected to an internal combustion engine, a vapor path connecting the fuel tank to the canister, a closing valve having a stepping motor and configured to open and close the vapor path, and an electric control unit configured to cause the closing valve to take an initial position in order to initialize the closing valve. The electric control unit is configured to determine whether it is in a predetermined initialization permission time when the initialization of the closing valve does not adversely affect running of the internal combustion engine. When it is determined that it is in the predetermined initialization permission time, the electric control unit is configured to output signals to start the initialization of the closing valve.

According to the aspect of this disclosure, the initialization of the stepping motor of the closing valve is performed during the initialization permission time. Thus, it is able to prevent a sudden change in the amount of the vaporized fuel flowing into the internal combustion engine caused by the initialization of the stepping motor, so that the disturbance of the air-fuel ratio in the engine can be prevented.

DETAILED DESCRIPTION

Each of the additional features and teachings disclosed above and below may be utilized separately or in conjunction with other features and teachings to provide improved vaporized fuel processing apparatuses. Representative examples, which utilize many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary in the broadest sense, and are instead taught merely to particularly describe representative examples. Moreover, various features of the representative examples and the dependent claims may be combined in ways that are not specifically enumerated in order to provide additional useful embodiments of the present teachings.

Figure 1:
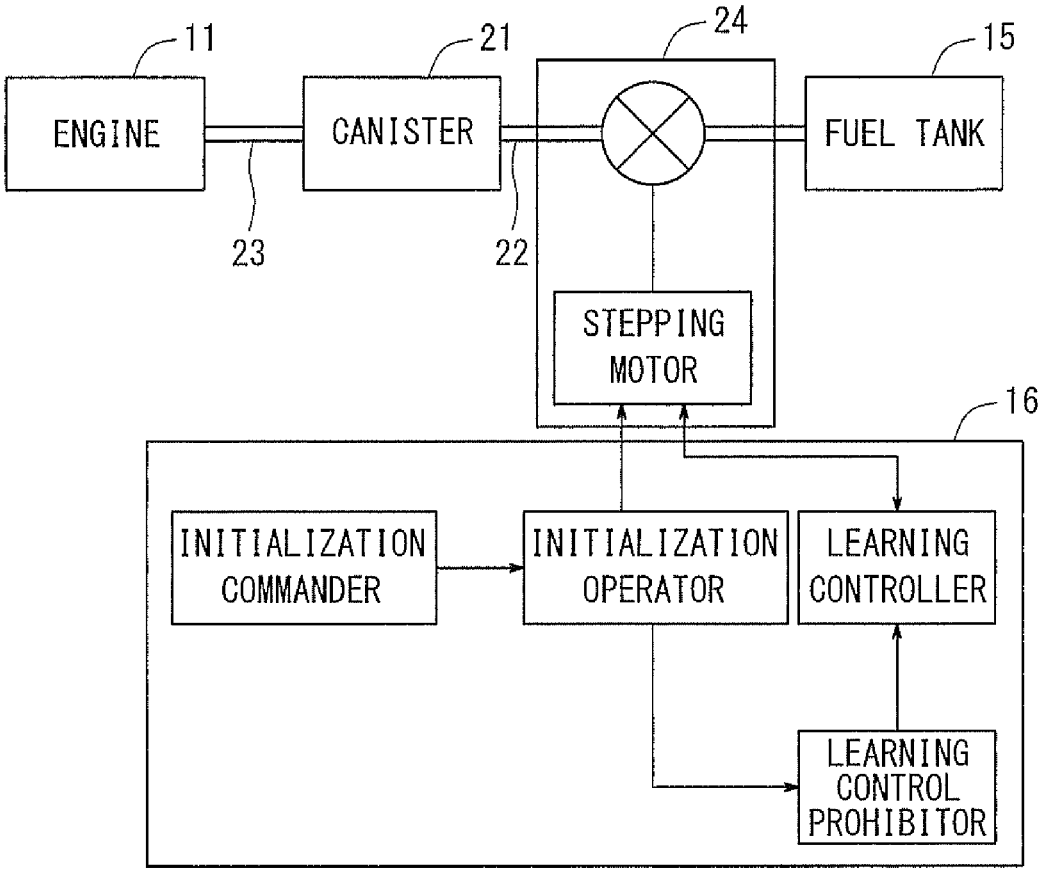
FIG. 1 is a schematic diagram of a vaporized fuel processing apparatus of this disclosure.
Figure 2:
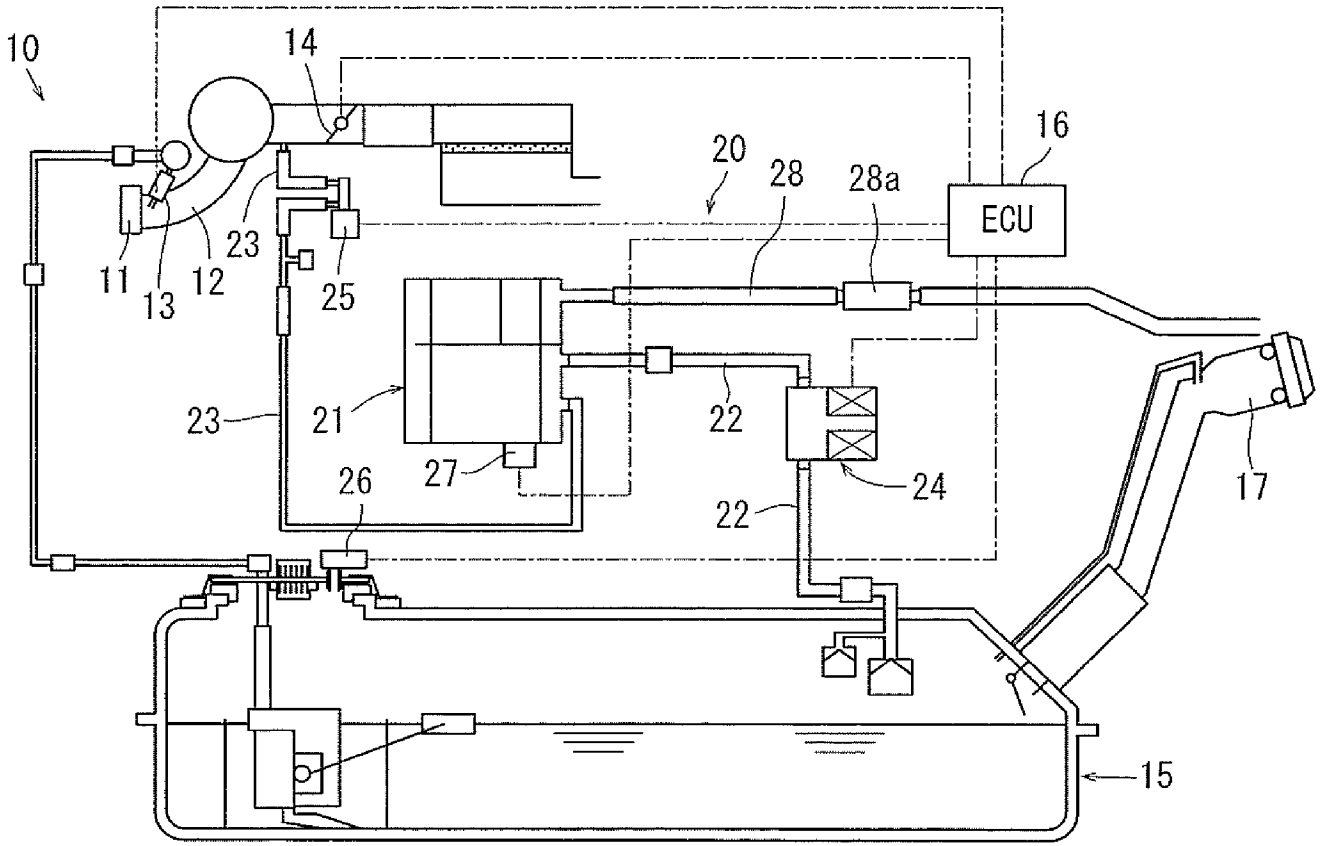
FIG. 2 is a diagram illustrating the construction of the vaporized fuel processing apparatus according to a first embodiment.
Figure 3:
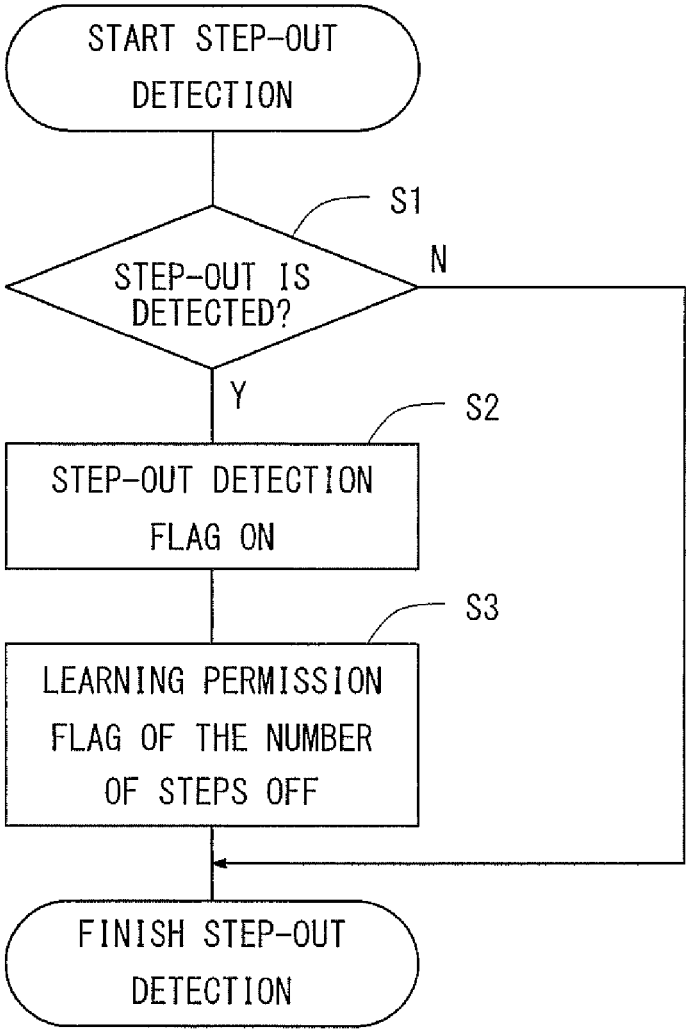
FIG. 3 is a flowchart showing an operation for detecting the step-out according to the first embodiment.
Figure 4:
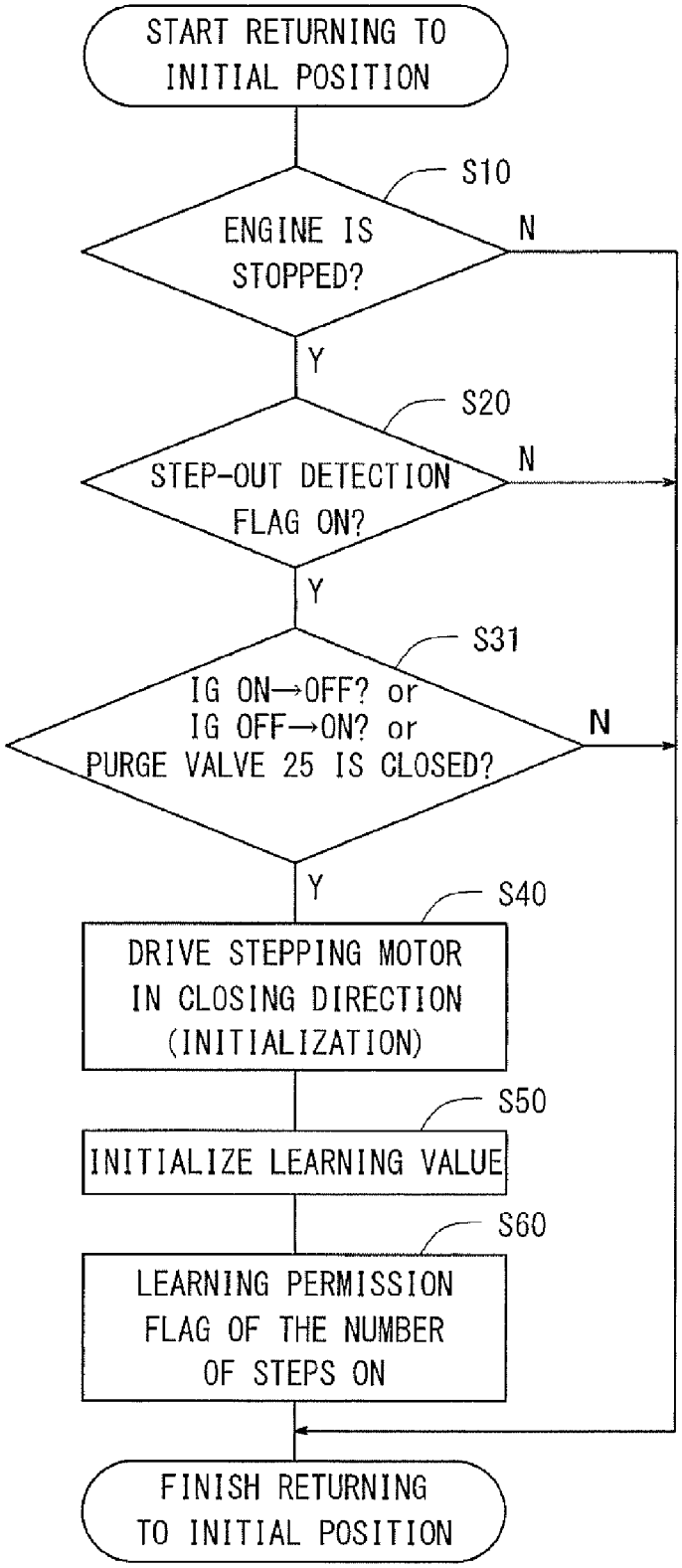
FIG. 4 is a flowchart showing an operation for returning to an initial position according to the first embodiment.

FIG. 1 shows a schematic view of a vaporized fuel processing apparatus of this disclosure. FIGS. 2-4 show a first embodiment of this disclosure. As shown in FIG. 2, in the first embodiment, an engine system 10 of a vehicle has a vaporized fuel processing apparatus 20.

The engine system 10 has known basic configurations, and is configured to supply mixed gas of air and fuel into an engine body 11 via an intake path 12. The amount of the fuel flowing into the engine body 11 is controlled by a fuel injection valve 13. The amount of the air flowing into the engine body 11 is controlled by a throttle valve 14. The fuel injection valve 13 and the throttle valve 14 are connected to an electric control unit (ECU) 16, respectively. The throttle valve 14 outputs signals relating to the opening degree of the throttle valve 14 to the ECU 16. The ECU 16 controls the open time of the fuel injection valve 13. The fuel injection valve 13 is supplied with fuel from a fuel tank 15.

In the vaporized fuel processing apparatus 20, fuel vapor generated during refueling and fuel vapor vaporized in the fuel tank 15 (referred to as vaporized fuel, hereinafter) is sent into a canister 21 via a vapor path 22 and is adsorbed in the canister 21. Then, the vaporized fuel is desorbed from the canister 21 and is supplied into the intake path 12 downstream of the throttle valve 14 via a purge path 23. The vapor path 22 is equipped with a stepping motor type closing valve (also referred to as closing valve, hereinafter) 24 for opening and closing the vapor path 22. That is, the closing valve 24 includes a stepping motor and is driven by the stepping motor. The purge path 23 is equipped with a purge valve 25 for opening and closing the purge path 23. The canister 21 is filled with an adsorbent such as activated carbon (not shown). The canister 21 is configured to adsorb the vaporized fuel on the adsorbent when the vaporized fuel flows into the canister 21 from the vapor path 22. The canister 21 is configured to release the vaporized fuel into the purge path 23 when the vaporized fuel is desorbed from the adsorbent. The canister 21 is connected to an atmospheric path 28. When the negative pressure is applied to the canister 21, the atmospheric air flows into the canister 21 via the atmospheric path 28 such that the vaporized fuel is purged from the adsorbent in the canister 21 and flows into the purge path 23. The atmospheric path 28 is positioned to suck the atmospheric air from a space near a fill opening 17 provided to the fuel tank 15. The atmospheric path 28 has an air filter 28*a*.

The ECU 16 receives various signals required for controlling the open time of the fuel injection valve 13. In addition to the signals relating to the opening degree of the throttle valve 14, the ECU 16 receives detection signals from a pressure sensor 26, which detects the inner pressure of the fuel tank 15, and detection signals from a temperature sensor 27, which detects the temperature of the canister 21. Further, in addition to control of the open time of the fuel injection valve 13, the ECU 16 controls the closing valve 24 and the purge valve 25 to be open and closed.

An operation for detecting the step-out of the stepping motor type closing valve 24, which is carried out by the ECU 16, will be described in reference to the flowchart of FIG. 3. At the step S1, it is determined whether the step-out of the stepping motor of the closing valve 24 is detected. This is determined based on whether the number of steps of the stepping motor corresponds to the valve opening position detected by a sensor. Alternatively, the determination may be carried out based on whether the inner pressure of the fuel tank 15 expectedly decreases when the stepping motor type closing valve 24 is opened by the predetermined number of steps in a state that the inner pressure of the fuel tank 15 is high. As a result of this determination, when the step-out is not detected, the step S1 is determined as No, and the operation for detection of the step-out shown in FIG. 3 is finished. On the other hand, when the step-out is detected, the step S1 is determined as Yes. Then, at the step S2, a step-out detection flag is set to be on, and the occurrence of the step-out is temporarily stored. Next, at the step S3, a learning permission flag for the number of steps of the stepping motor type closing valve 24 is reset. Here, in the learning of the number of steps, the stepping motor type closing valve 24 is driven from a standby position where the closing valve 24 is completely closed toward the valve opening position where the closing valve 24 is substantially open and the vaporized fuel starts to flow from the fuel tank 15 therethrough. The learning of the number of steps means learning control for storing the number of steps of the stepping motor at the valve opening position as learning value. When the learning permission flag is reset at the step S3, the learning control is prohibited.

FIG. 4 shows an operation for returning the stepping motor type closing valve 24 to its initial position, which is performed by the ECU 16. When this operation starts, it is determined whether the internal combustion engine is stopped at the step S10. And, at the step S20, it is determined whether the step-out detection flag is set to be on. Further, at the step S31, it is determined whether an ignition switch of the vehicle is changed from on to off or from off to on, or whether the purge valve 25 is closed. When any one of the steps S10-S31 is determined as No, the operation for returning to the initial position shown in FIG. 4 is finished.

When the engine is stopped, when the step-out is detected and the step-out detection flag is set to be on in the step-out detection operation of FIG. 3, and when the ignition switch of the vehicle is changed from on to off or off to on or the purge valve 25 is closed, all of the steps S10-S31 are determined as Yes. Then, at the step S40, the stepping motor of the closing valve 24 is driven such that the closing valve 24 is operated in the valve closing direction in order to initialize the closing valve 24, that is, to return the closing valve 24 to the initial position. At the step S50, the learning value of the learning control is initialized. In addition, at the step S60, the learning permission flag of the learning control is set to be on such that the learning control is permitted. After finishing the operation of the step S60, the operation for returning to the initial position shown in FIG. 4 is finished.

Even when the step-out of the closing valve 24 is detected by the step-out detection operation shown in FIG. 3, the initialization of the stepping motor is not immediately carried out. The detection of the step-out is temporarily stored at the step S2, and the learning control of the number of steps of the stepping motor is prohibited at the step S3. Then, when the ignition switch of the vehicle is changed from on to off or from off to on by the operation for returning to the initial position shown in FIG. 4, the initialization of the stepping motor, the initialization of the learning value, and the permission of the learning control are performed.

As described above, immediately after change of the ignition switch of the vehicle from on to off or from off to on, that is, when the engine does not operate, or when the purge valve 25 is closed, the initialization of the stepping motor after detection of the step-out is carried out. Thus, the initialization of the stepping motor in the step-out condition does not cause a sudden change of the amount of the vaporized fuel flowing into the internal combustion engine. Because it is able to prevent the sudden change of the amount of the vaporized fuel flowing into the internal combustion engine, the disturbance of the air-fuel ratio in the engine can be prevented. And, when the step-out of the stepping motor is detected, the learning control relating to the valve opening position of the closing valve 24 is prohibited before finishing initialization of the stepping motor. Then, when the initialization of the stepping motor is finished, the learning value in the learning control is initialized and the learning control is permitted. So, it is preventing disturbance of the learning value caused by malfunction of the learning control relating to the valve opening position of the closing valve 24 due to the step-out of the stepping motor.

Figure 5:
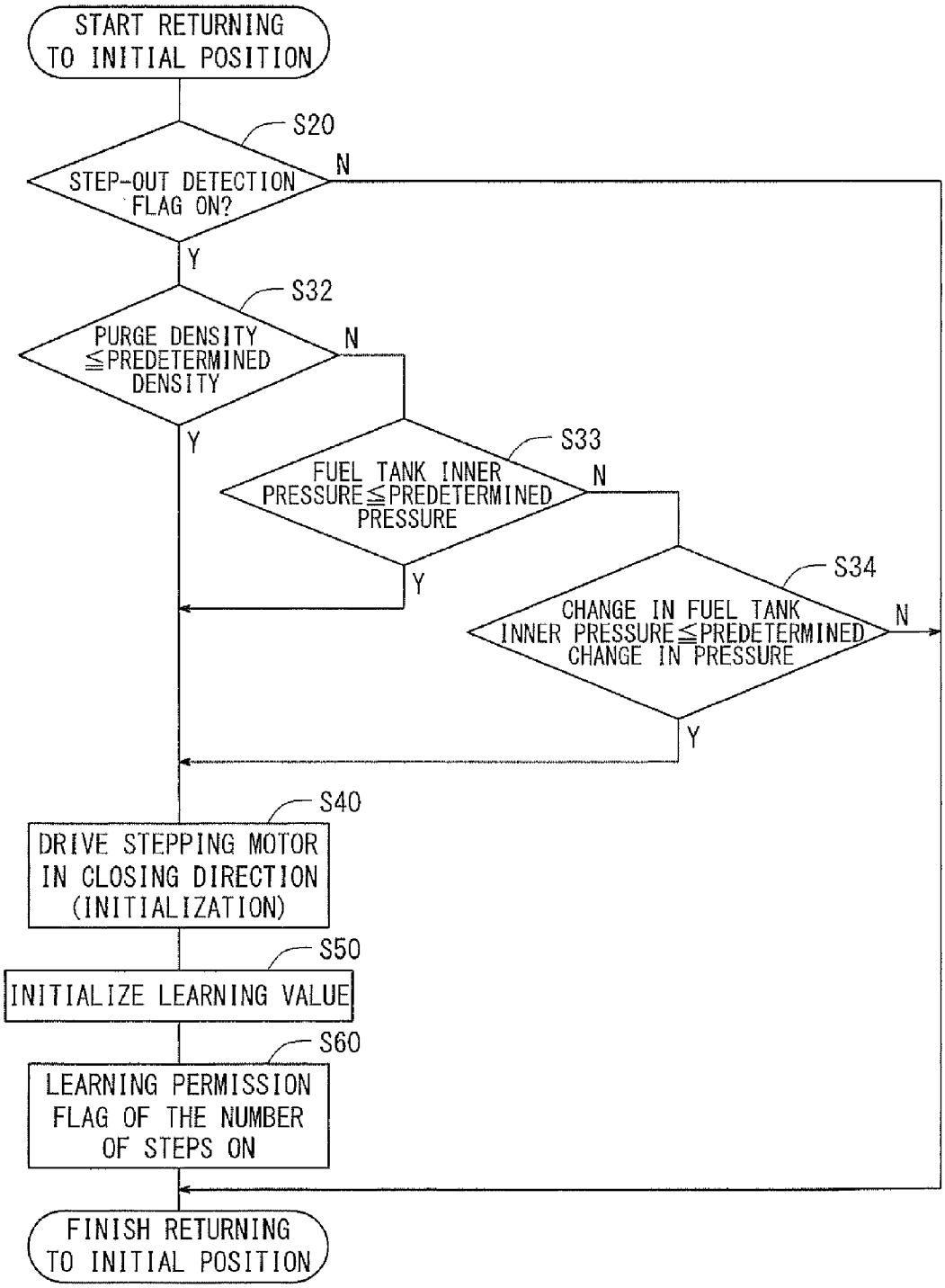
FIG. 5 is a flowchart showing an operation for returning to the initial position according to a second embodiment.

FIG. 5 shows an operation for returning the stepping motor type closing valve 24 to its initial position according to the second embodiment. When this operation is started, as with the step S20 in FIG. 4, it is determined whether the step-out detection flag is set to be on. When the step-out detection flag is not set and when the step S20 is determined as No, the operation for returning to the initial position in FIG. 5 is finished.

When the step-out is detected, when the step-out detection flag is set to be on, and when the step S20 is determined as Yes, at the step S32, it is determined whether the density of the vaporized fuel purged into the engine body 11 from the canister 21 is equal to or lower than a predetermined density. And, at the step S33, it is determined whether the inner pressure of the fuel tank 15 is equal to or lower than a predetermined pressure, that is, the fuel tank 15 is depressurized. Further, at the step S34, it is determined whether the change in the inner pressure of the fuel tank 15 is equal to or lower than a predetermined change in pressure. When all of the steps S32-S34 are determined as No, the operation for returning to the initial position in FIG. 5 is finished. When any one of the steps S32-S34 is determined as Yes, as with the case in FIG. 4, the steps S40-S60 are carried out, and the operation for returning to the initial position in FIG. 5 is finished.

Because the operation for returning to the initial position in FIG. 5 is performed as described above, the initialization after detection of the step-out of the stepping motor is carried out at the time when the density of the vaporized fuel purged into the engine body 11 from the canister 21 is equal to or lower than the predetermined density, when the inner pressure of the fuel tank 15 is equal to or lower than the predetermined pressure, or when the change in the inner pressure of the fuel tank 15 is equal to or lower than the predetermined change in the inner pressure. At each of these timings, the amount of the vaporized fuel flowing into the engine body 11 from the fuel tank 15 is small, and the closing valve 24 is closed in order to carry out the initialization after detection of the step-out. That is, because the initialization of the stepping motor after detection of the step-out is carried out at the time when such operation does not adversely affect the driving of the engine, the sudden change of the amount of the vaporized fuel flowing into the engine caused by such initialization can be prevented. As a result, the disturbance of the air-fuel ratio in the engine can be prevented. Here, for example, it is determined whether the purge fuel density is equal to or lower than the predetermined density based on a decrease correction value of a feedback correction amount of the fuel injection amount in a control operation for controlling the valve opening time of the fuel injection valve 13. And, it is determined whether the inner pressure of the fuel tank 15 is equal to or lower than the predetermined pressure based on output signals from the pressure sensor 26. It is determined whether the change in the inner pressure of the fuel tank 15 is equal to or lower than the predetermined change in the inner pressure based on a differential value of the output signals from the pressure sensor 26.

Figure 6:
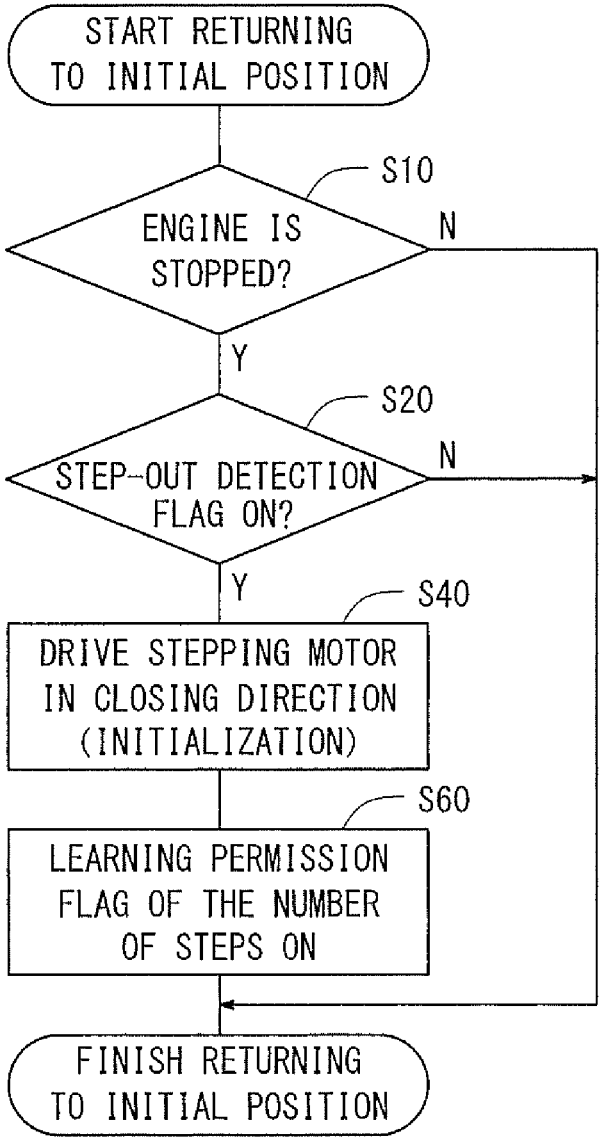
FIG. 6 is a flowchart showing an operation for returning to the initial position according to a third embodiment.

FIG. 6 shows an operation for returning the closing valve 24 to its initial position according to a third embodiment. The operation according to the third embodiment does not include the step S31 nor the step S50, which are included in the first embodiment in FIG. 4. Thus, when the engine is stepped in a condition that the step-out of the stepping motor is detected, the steps S10 and S20 are determined as Yes. So, at the step S40, the closing valve 24 is driven in the closing direction by operating the stepping motor of the closing valve 24 in order to initialize the closing valve 24, that is, to return the closing valve 24 to its initial position. Then, at the step S60, the learning permission flag of the learning control is set to be on, so that the learning control is permitted. After completing the step S60, the operation for returning to the initial position in FIG. 6 is finished.

As described above, because the initialization after detection of the step-out of the stepping motor is carried out in a condition that the engine is not running, the sudden change in the amount of the vaporized fuel flowing into the engine caused by the initialization of the stepping motor after the step-out can be prevented. Thus, the disturbance of the air-fuel ratio in the engine can be prevented. And, after detection of the step-out of the stepping motor, the learning control relating to the valve opening position of the closing valve 24 is prohibited before completion of the initialization of the stepping motor, and then, when the initialization of the stepping motor is completed, the learning control is permitted. Therefore, the disturbance of the learning value caused by malfunction of the learning control relating to the valve opening position of the closing valve due to the step-out of the stepping motor can be prevented.

The operation at the step S40 in the first to third embodiments corresponds to an initialization operator in this disclosure. The operations at the steps S10, S20, S31, S32, S33 and S34 correspond to an initialization commander in this disclosure. The operation at the step S60 corresponds to a learning controller in this disclosure. The operation at the step S3 corresponds to a learning control prohibitor in this disclosure. The operation at the step S50 corresponds to a learning value initialization operator.

The invention claimed is:

1. A vaporized fuel processing apparatus comprising:

a fuel tank;

a canister configured to adsorb vaporized fuel and connected to an internal combustion engine;

a vapor path connecting the fuel tank to the canister;

a closing valve having a stepping motor and configured to open and close the vapor path; and an electric control unit configured to cause the closing valve to an initial position in order to initialize the closing valve;

wherein the electric control unit is configured to determine whether it is in a predetermined initialization permission time when the initialization of the closing valve does not adversely affect running of the internal combustion engine; and wherein when it is determined that it is in the predetermined initialization permission time, the electric control unit is configured to output signals to start the initialization of the closing valve;

wherein the electric control unit is configured to detect the step-out of the stepping motor;

wherein the electric control unit is configured to store the number of steps of the stepping motor as a learning value when the vaporized fuel starts to flow through the closing valve after driving the closing valve from a valve closed position of the closing valve in the opening direction; and wherein when the step-out of the stepping motor is detected, the electric control unit is configured to prohibit to store the number of steps as the learning value before the initialization of the closing valve is completed.

2. The vaporized fuel processing apparatus according to claim 1, wherein the predetermined initialization permission time is a time when the step-out of the stepping motor is detected and when the internal combustion engine is stopped.

3. The vaporized fuel processing apparatus according to claim 1, wherein the predetermined initialization permission time is when the internal combustion engine is started, when the internal combustion engine is stopped, or when the amount of the vaporized fuel flowing into the internal combustion engine from the canister is zero.

4. A vaporized fuel processing apparatus comprising:

a fuel tank;

a canister configured to adsorb vaporized fuel and connected to an internal combustion engine;

a vapor path connecting the fuel tank to the canister;

a closing valve having a stepping motor and configured to open and close the vapor path; and an electric control unit configured to cause the closing valve to an initial position in order to initialize the closing valve;

wherein the electric control unit is configured to detect the step-out of the stepping motor;

wherein the electric control unit is configured to determine whether it is in a predetermined initialization permission time; and wherein when the step-out of the stepping motor is detected and when it is determined that it is in the predetermined initialization permission time, the electric control unit is configured to output signals to start the initialization of the closing valve;

wherein the electric control unit is configured to store the number of steps of the stepping motor as a learning value when the vaporized fuel starts to flow through the closing valve after driving the closing valve from the valve closed position of the closing valve in the opening direction: and wherein when the step-out of the stepping motor is detected, the electric control unit is configured to prohibit to store the number of steps as the learning value before the initialization of the closing valve is completed.

5. The vaporized fuel processing apparatus according to claim 4, wherein the predetermined initialization permission time is a time when the step-out of the stepping motor is detected and when the internal combustion engine is stopped.

6. The vaporized fuel processing apparatus according to claim 4, wherein the predetermined initialization permission time is when the internal combustion engine is started, when the internal combustion engine is stopped, or when the amount of the vaporized fuel flowing into the internal combustion engine from the canister is zero.

* * * * *